US007832390B2

(12) United States Patent
Hsu et al.

(10) Patent No.: US 7,832,390 B2
(45) Date of Patent: Nov. 16, 2010

(54) COOKING APPARATUS WITH BURNING DRAWERS THAT MAY BE REMOVED AND EXCHANGED SO THAT IT CAN BE FIRED BY EITHER NATURAL GAS, OR WOOD OR CHARCOAL

(76) Inventors: Shih Kwang Hsu, 8916 Harness Trail, Potomac, MD (US) 20854-2500; Jeff Wonderley, 2099 Knightly Mill Rd., Fort Defiance, VA (US) 24437-2127

( * ) Notice: Subject to any disclaimer, the term of this patent is extended or adjusted under 35 U.S.C. 154(b) by 250 days.

(21) Appl. No.: 12/105,250

(22) Filed: Apr. 17, 2008

(65) Prior Publication Data

US 2008/0190408 A1 Aug. 14, 2008

Related U.S. Application Data

(63) Continuation-in-part of application No. 11/372,085, filed on Mar. 10, 2006, now abandoned, and a continuation-in-part of application No. 11/585,883, filed on Oct. 25, 2006, now abandoned, which is a continuation-in-part of application No. 10/979,244, filed on Nov. 3, 2004, now abandoned, and a continuation-in-part of application No. 11/373,085, filed on Mar. 10, 2006, now abandoned.

(51) Int. Cl.
*F24C 1/02* (2006.01)
*F24C 3/00* (2006.01)

(52) U.S. Cl. ..... 126/36; 126/41 D; 126/50; 126/39 R; 126/25 R

(58) Field of Classification Search ..... 126/36, 126/41 D, 41 R, 50, 41 E, 39 R, 25 R, 37 R
See application file for complete search history.

(56) References Cited

U.S. PATENT DOCUMENTS 2,141,808 A 12/1938 Brodbeck
3,295,509 A * 1/1967 Harvey ..... 126/25 B (Continued)

FOREIGN PATENT DOCUMENTS

CA 2453703 A1 * 6/2005

(Continued)

*Primary Examiner*—Kenneth B Rinehart
*Assistant Examiner*—Daniel A Bernstein
(74) *Attorney, Agent, or Firm*—Swift Law Office; Stephen Christopher Swift

(57) ABSTRACT

A cooking grill or other cooking apparatus with heating drawers that may be slid into and out of a cabinet assembly like a drawer in a desk or dresser. There are two types of burning drawers, both of which have rectangular box-like shapes, with the same dimensions, so that either one of them can be inserted into the same slots in the cabinet assembly. The first type of drawer is designed for wood or charcoal. The second type of drawer is designed for natural gas. One drawer can be slid out, and the other drawer can be slid in. There are three type of cooking surfaces: a wok grill with a radially grating, a teriyaki plate with a solid surface, and a barbeque grill having apertures in a staggered array. The first embodiment has four drawers and two cooking areas. The second embodiment has three drawers and three cooking areas.

14 Claims, 17 Drawing Sheets

U.S. PATENT DOCUMENTS

| | | | | | |
|---|---|---|---|---|---|
| 3,824,984 | A | | 7/1974 | Swanson et al. | |
| 4,321,857 | A | * | 3/1982 | Best | 99/340 |
| 4,706,643 | A | * | 11/1987 | Tyson | 126/25 R |
| 4,819,614 | A | | 4/1989 | Hitch | |
| 4,899,725 | A | * | 2/1990 | Barron, Jr. | 126/41 R |
| 5,203,317 | A | * | 4/1993 | James | 126/41 R |
| 5,481,965 | A | | 1/1996 | Kronman | |
| 5,524,610 | A | | 6/1996 | Clark | |
| 5,572,984 | A | * | 11/1996 | Alden et al. | 126/299 R |
| D386,044 | S | | 11/1997 | Stuck | |
| 5,711,209 | A | * | 1/1998 | Guines | 99/339 |
| 5,878,739 | A | | 3/1999 | Guidry | |
| 6,000,389 | A | * | 12/1999 | Alpert | 126/25 R |
| 6,050,177 | A | * | 4/2000 | Lassig, Jr. | 99/340 |
| 6,161,534 | A | | 12/2000 | Kronman | |
| 6,173,644 | B1 | | 1/2001 | Krall | |
| 6,182,560 | B1 | | 2/2001 | Andress | |
| 6,523,461 | B1 | | 2/2003 | Johnston et al. | |
| 6,640,800 | B1 | | 11/2003 | Hodgson et al. | |
| 6,923,110 | B2 | | 8/2005 | Alazet | |
| 7,150,278 | B1 | * | 12/2006 | Hampton | 126/38 |
| 2003/0177913 | A1 | | 9/2003 | Dellinger | |
| 2005/0022801 | A1 | * | 2/2005 | Wu | 126/25 R |
| 2005/0028803 | A1 | * | 2/2005 | Jiang | 126/25 A |
| 2006/0174863 | A1 | * | 8/2006 | Menegon | 126/37 R |

FOREIGN PATENT DOCUMENTS

| | | |
|---|---|---|
| JP | 2001-248843 | 9/2001 |

* cited by examiner

COOKING APPARATUS WITH BURNING DRAWERS THAT MAY BE REMOVED AND EXCHANGED SO THAT IT CAN BE FIRED BY EITHER NATURAL GAS, OR WOOD OR CHARCOAL

CROSS REFERENCE TO RELATED APPLICATIONS

This application is a Continuation-In-Part of Regular Utility patent application Ser No. 11/372,085, filed Mar. 10, 2006, and of Regular Utility patent application Ser. No. 11/585,883, filed Oct. 25, 2006 (which was a Continuation-In-Part of Regular Utility patent application Ser. No. 10/979,244, filed Nov. 3, 2004, now abandoned, and of the aforementioned Regular Utility patent application Ser. No. 11/372,085, filed Mar. 10, 2006). All of the aforementioned patent applications are incorporated herein by reference.

BACKGROUND OF THE INVENTION

1. Field of the Invention

The present invention relates to cooking apparatus that can use different fuels.

2. Description of the Prior Art

There have been previous inventions for allowing the use of different fuels in the same cooking apparatus, but none that are equivalent to the present invention.

U.S. Pat. No. 2,141,808, issued on Dec. 27, 1938, to Almer H. Brodbeck, discloses a combination solid and gaseous fuel cooking range. The instant invention is distinguishable, in that it has the solid and gas cooking elements in separate removable and exchangeable burning drawers, or in a single burning drawer that may be adapted to burn either kind of fuel.

U.S. Pat. No. 3,384,984, issued on Jul. 23, 1974, to Marvin C. Swanson and Harold R. Swanson, discloses a charcoal grill conversion apparatus, in which a grate is placed over a gas burner to allow the use of charcoal.

U.S. Pat. No. 4,819,614, issued on Apr. 11, 1989, to Robert J. Hitch, discloses a dual fuel barbeque grill, in which a compartment for burning charcoal is added to a gas or electric burner, rather than being substituted for a gas burner, as in the instant invention.

U.S. Pat. No. 5,481,965, issued on Jan. 9, 1996, to Leonard Kronman, discloses a rack and screen assembly for converting gas grilles into charcoal and/or wood burning stations, which is added over the gas burner, rather than being substituted for it, as in the instant invention.

U.S. Pat. No. 5,524,610, issued on Jun. 11, 1996, to John D. Clark, discloses a cooking device that combines elements for cooking food with solar power, charcoal, gas and other means, all in one non-removable compartment.

U.S. Pat. No. 5,711,209, issued on Jan. 27, 1998, to James T. Guines, discloses a barbeque stove that can use heating means such as wood, coal, charcoal, gas or electricity, but without the removable and exchangeable gas and solid fuel burning drawers of the instant invention.

U.S. Pat. No. 5,878,739, issued on Mar. 9, 1999, to Gregg A. Guidry, discloses a combination gas and charcoal grill, in which the gas and charcoal burning elements are present simultaneously.

U.S. Pat. No. 6,000,389, issued on Dec. 14, 1999, to Gerald Alpert, discloses a combination gas and charcoal grill, including a housing, a heat distribution element, a gas burner, and an ash pan drawer, but without the removable and exchangeable burning drawers of the instant invention.

U.S. Pat. No. 6,050,177, issued on Apr. 18, 2000, to O. L. Lassig, Jr., discloses a multi-fuel, fuel isolated cooker, with separate drawers for solid fuel, gas and electric heating, where the food is isolated from direct contact with the heat source. The instant invention is distinguishable, because in it the food is directly over the gas or solid fuel.

U.S. Pat. No. 6,161,534, issued on Dec. 19, 2000, to Leonard Kronman, discloses a method and apparatus for converting a gas grill to a charcoal burning grill, without removing the gas burners.

U.S. Pat. No. 6,173,644, issued on Jan. 16, 2001, to Michael A. Krall, discloses an apparatus for converting a gas grill into a charcoal burning grill, including an adapter container for holding the charcoal covered by a screen, without removing the gas burners, as in the instant invention.

U.S. Pat. No. 6,182,560, issued on Feb. 6, 2001, to Alphonso G. Andress, discloses a multi-level barbeque grill that may use either gas or charcoal, but without the removable and exchangeable burning drawers of the instant invention.

U.S. Pat. No. 6,523,461, issued on Feb. 25, 2003, to Robert Johnson and Bradley G. Gillespie, discloses a charcoal tray and cooking rack to permit the use of charcoal in a gas grill, without removing the gas burners.

U.S. Pat. No. 6,640,800, issued on Nov. 4, 2003, to David A. Hodgson and Ginny Hodgson, discloses a multiple fuel cooking apparatus, that may use either gas, charcoal briquettes or smoking chips, but does not disclose the removable and exchangeable burning drawers of the instant invention.

U.S. Pat. No. 6,923,110, issued on Aug. 2, 2005, to Jean Alazet, discloses a vertical-pit barbeque using charcoal, lava rock, wood, gas and other fuels.

U.S. Pat. No. Des. 386,044, issued on Nov. 11, 1997, to Robert M. Stuck, discloses a design for a gas-fired burner with charcoal briquette support.

U.S. Patent Application Publication No. 2003/0177913, issued on Sep. 25, 2003, to J. Scott Dellinger, discloses a flap assembly for enabling the use of charcoal over gas burners.

Japanese Patent No. 2001-248843, published on Sep. 14, 2001, inventor Masashiro Miura, discloses a heating implement with combined charcoal fire and gas cooking appliances.

None of the above inventions and patents, taken either singly or in combination, is seen to describe the instant invention as claimed.

SUMMARY OF THE INVENTION

The present invention is a cooking grill or other cooking apparatus with burning drawers that may be slid into and out of a heating space like a drawer in a desk or dresser. The invention makes it convenient to cook with both solid and gas fuel. In the first preferred embodiment, there are two types of burning drawers, both of which have rectangular box-like shapes, with the same dimensions, so that either one of them can be inserted into the same slots. The first type of drawer is designed for wood or charcoal. The second type of drawer is designed for natural gas. When it is desired to change from cooking with one kind of fuel to the other kind, one type of drawer can be slid out of an upper slot and stored in a lower slot, and the other type of drawer can be slid in to the upper slot. There are also three types of cooking plates, each of which can be removably inserted into either of two openings in a surface plate.

In the second preferred embodiment, there are three cooking areas with different permanent surfaces, the first and second of which are always heated by gas. A third cooking area can be heated by either gas or solid fuel, using burning drawers as in the first embodiment. There is also a non-burning storage drawer.

Accordingly, it is a principal object of the invention to provide an apparatus that makes it easy to convert a cooking device from using solid fuel to using gas.

It is another object of the invention to provide an apparatus that makes it easy to convert a cooking device from using gas to using solid fuel.

It is a further object of the invention to make it easier to cook different kinds of food on the same cooking device, where different fuel is optimal for different food.

Still another object of the invention is to make it easier to use a cooking device in different settings, where different fuels are available.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
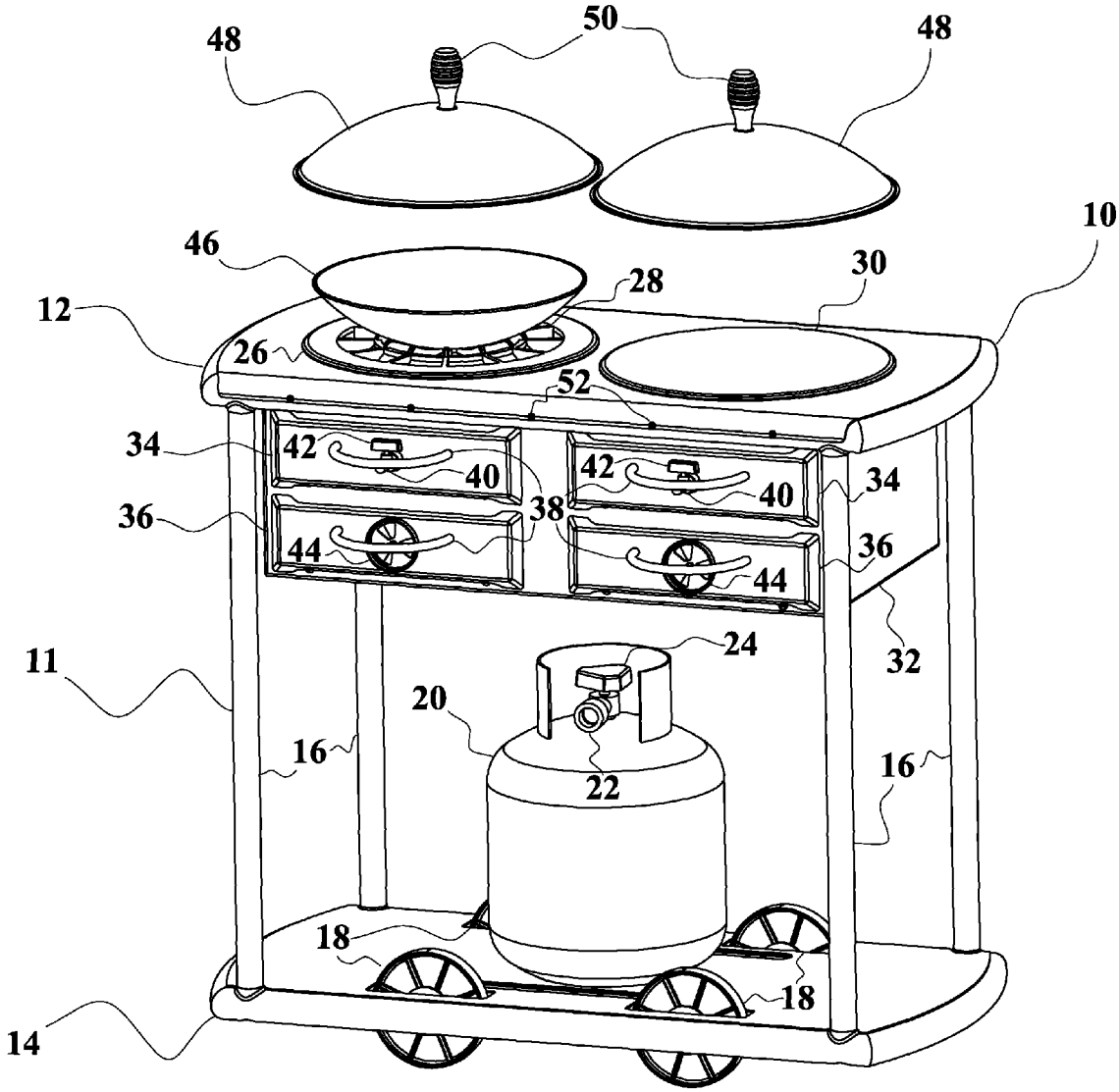
FIG. 1 is a perspective view of the first preferred embodiment of the invention, showing the wok grill plate and the teriyaki plate in use.

FIG. 1 is a perspective view of the first preferred embodiment of the invention 10, including frame assembly 11 with surface plate 12 (preferably made of stainless steel) and bottom panel 14 (preferably made of steel with a power coat finish) connected by supporting members 16. Wheels 18 are set in the lower horizontal member, so that the apparatus can be moved on a floor or other surface. A tank 20, which may contain propane or other natural gas, rests on the lower horizontal member. The tank has an outlet 22, and a knob 24 by which the flow of gas through the outlet may be controlled. A wok grill plate 26 (preferably made of cast iron coated with porcelain) with a radially grated center 28, and a teriyaki plate 30 (preferably made of cast iron) with a solid surface having no apertures, rest in openings in the surface plate. A cabinet assembly 32 has slots holding gas burning drawers 34 and solid fuel (such as charcoal or wood) burning drawers 36. Each drawer has a handle 38, behind which is a gas inlet 40 with control knob 42 (for the gas burning drawers) or an adjustable air vent 44 (for the solid fuel burning drawers). The outlet of the tank and the inlets of the gas burning drawers may by connected by a single hose or three hoses with a connector (not shown in the drawings). The drawers that are being used to provide heat are placed in the upper slots, while the drawers that are not in use are stored in the lower slots. The drawers may be easily removed and reinserted in different slots, when it is desired to change the heat source for either or both openings in the surface plate. A wok 46 rests on the wok grill plate. Round lids 48 for covering the wok and the teriyaki plate are shown raised above them. Handles 50 allow the lids to be raised and lowered by hand. Screws 52 retain the surface plate.

Figure 2:
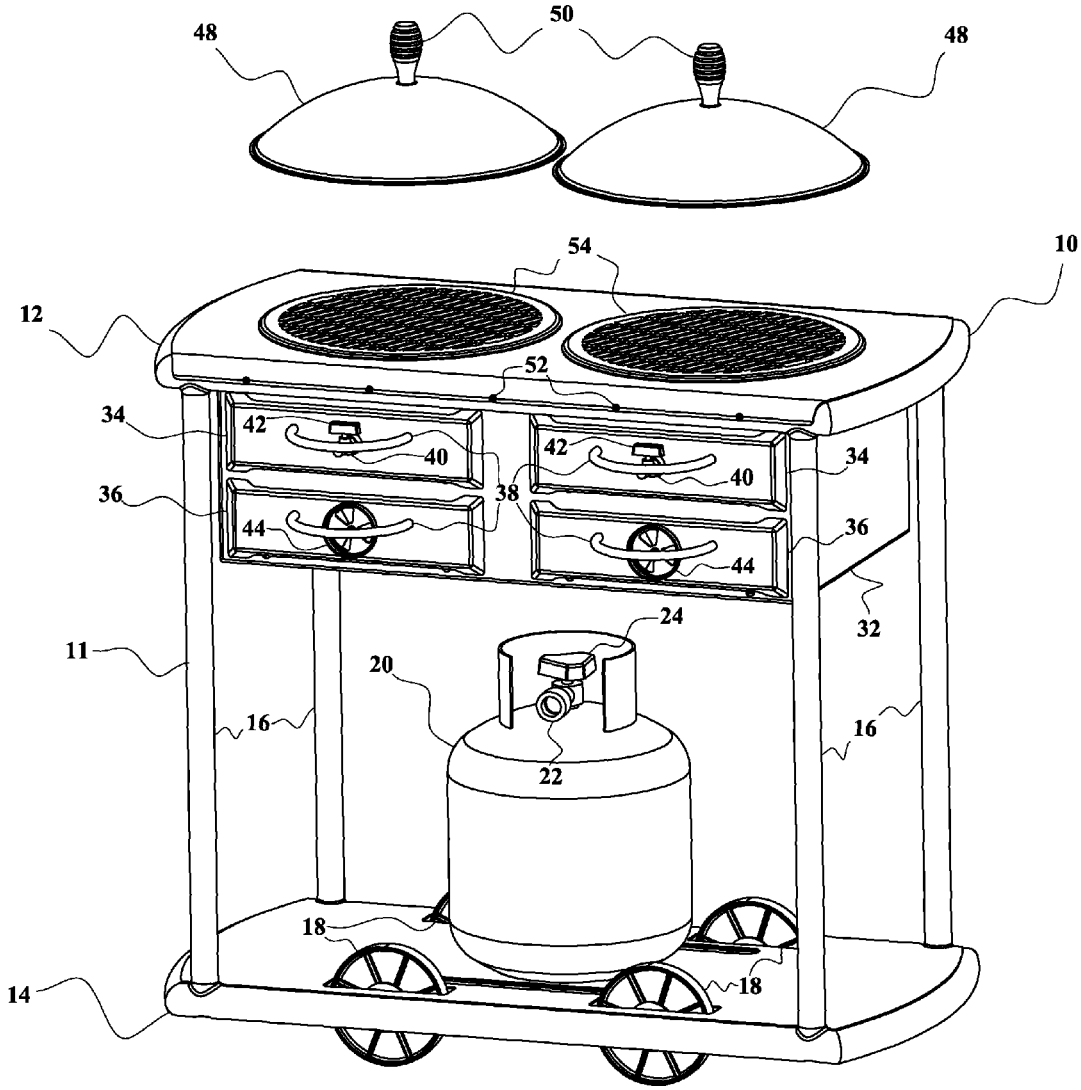
FIG. 2 is a perspective view of the first preferred embodiment of the invention, showing the barbeque plate in use.

FIG. 2 is a perspective view of the first preferred embodiment of the invention, showing barbeque grill plates 54 (which are preferably made of cast iron coated with porcelain) having numerous elongated apertures in a staggered array, resting in the openings in the surface plate. A wok grill plate, a teriyaki plate, or a barbeque plate may be easily inserted or removed from either opening in the surface plate. Preferably, two of each of the three kinds of plates should be provided when the apparatus is sold, so that any of the three cooking surfaces can be used in both openings, if desired.

Figure 3:
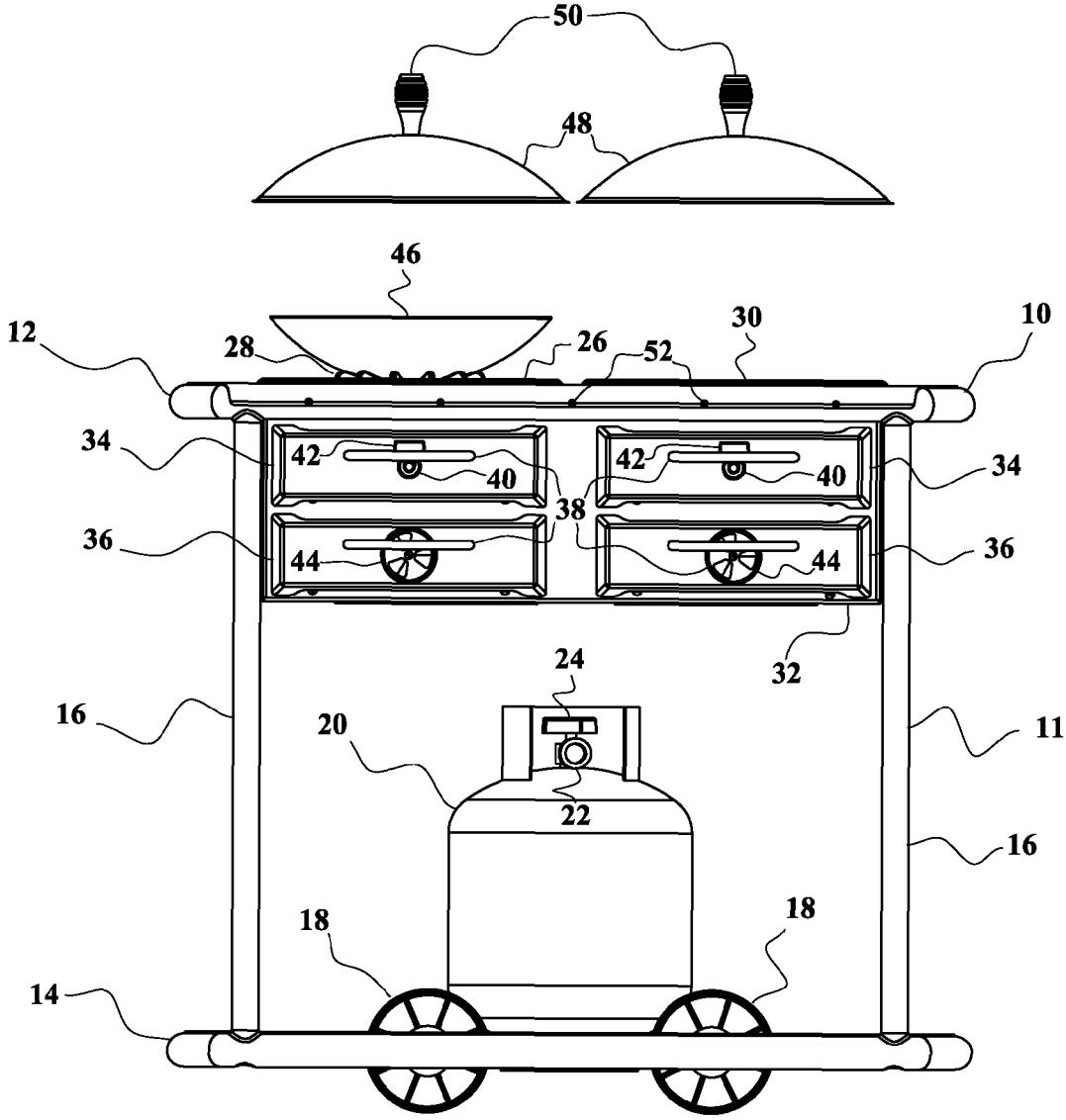
FIG. 3 is a front elevational view of the first preferred embodiment of the invention.

FIG. 3 is a front elevational view of the first preferred embodiment of the invention. It can be seen how the radially grated center 28 of the wok grill plate retains the wok 46.

Figure 4:
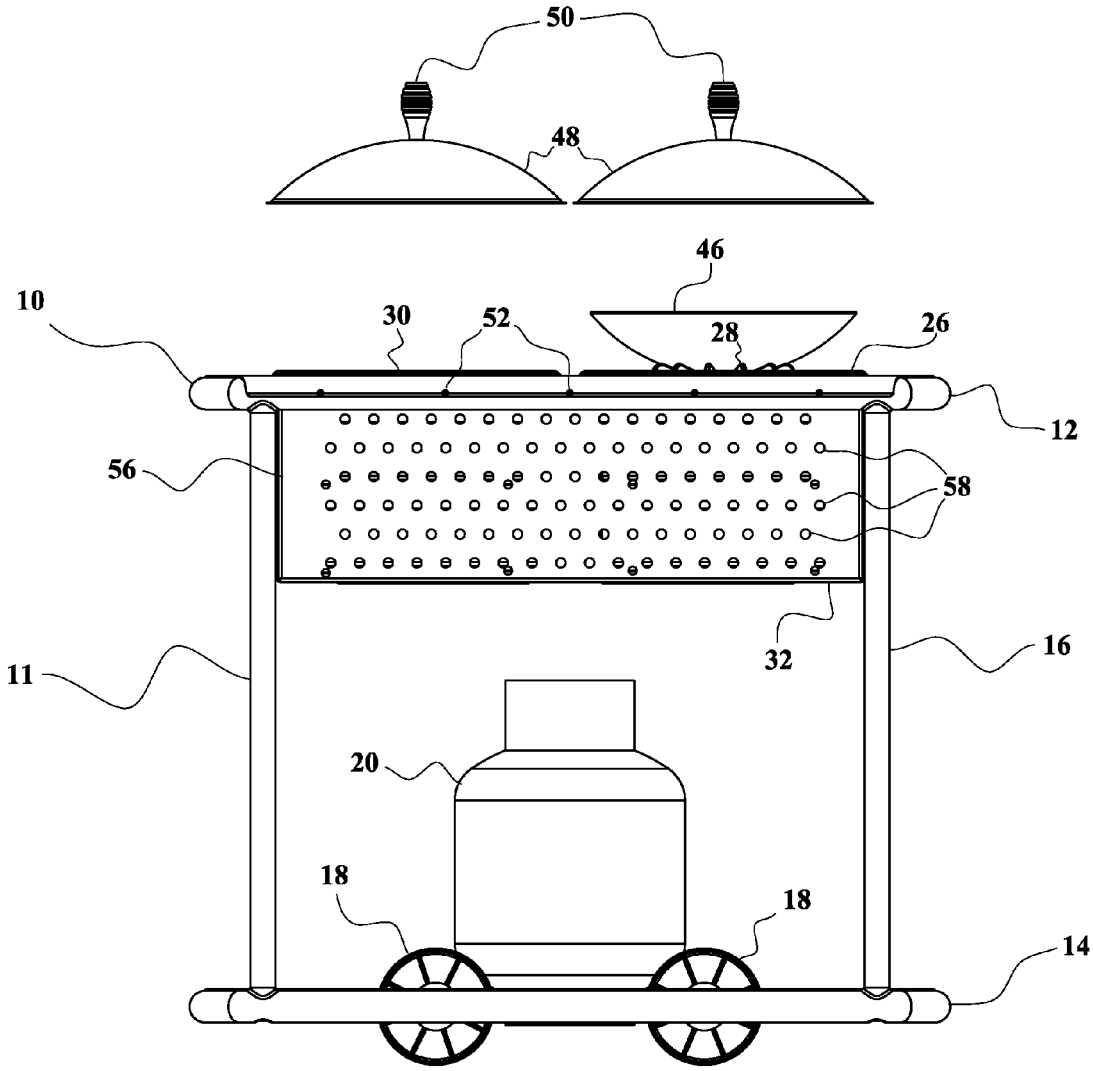
FIG. 4 is a rear elevational view of the first preferred embodiment of the invention.

FIG. 4 is a rear elevational view of the first preferred embodiment of the invention, showing the rear panel 56 of the cabinet assembly, with numerous apertures 58 for air flow.

Figure 5:
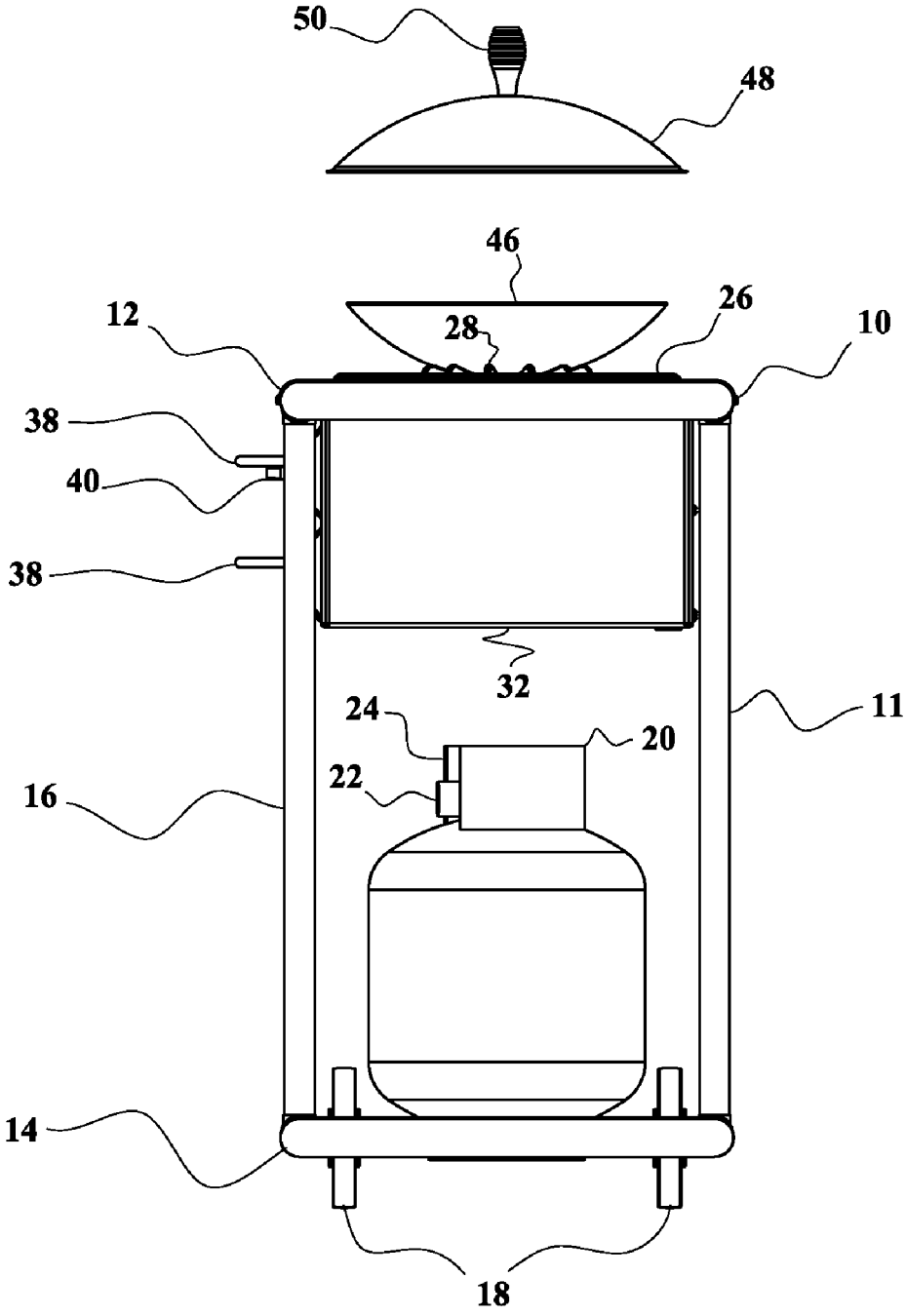
FIG. 5 is a right side elevational view of the first preferred embodiment of the invention.
Figure 6:
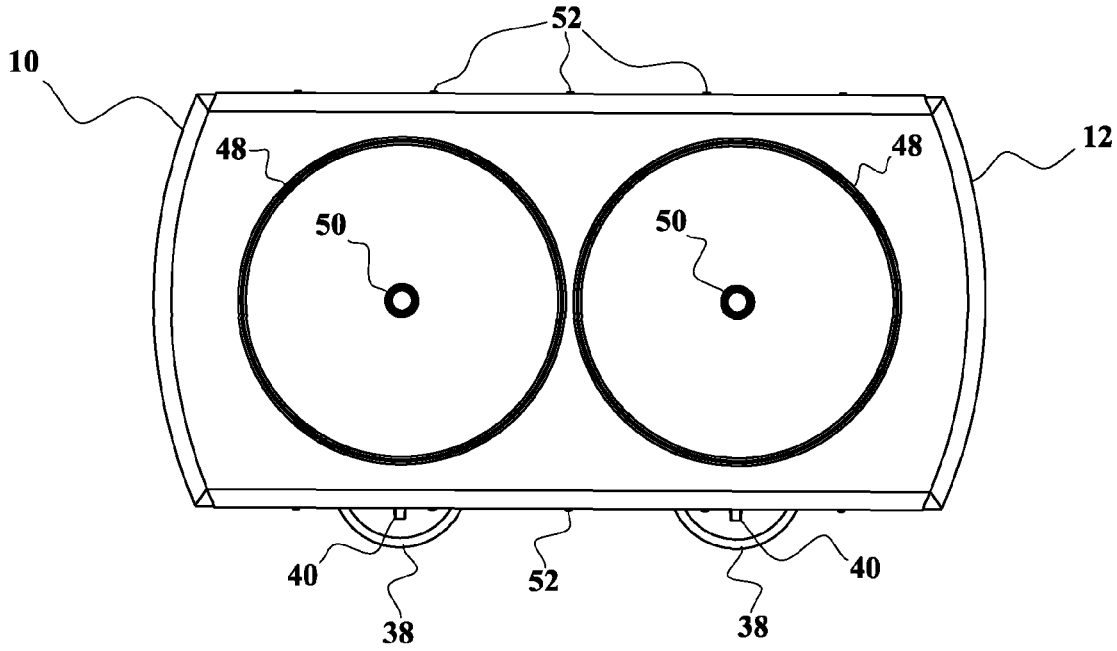
FIG. 6 is a top plan view of the first preferred embodiment of the invention.

FIG. 5 is a right side elevational view of the first preferred embodiment of the invention. FIG. 6 is a top plan view of the first preferred embodiment of the invention.

Figure 7:
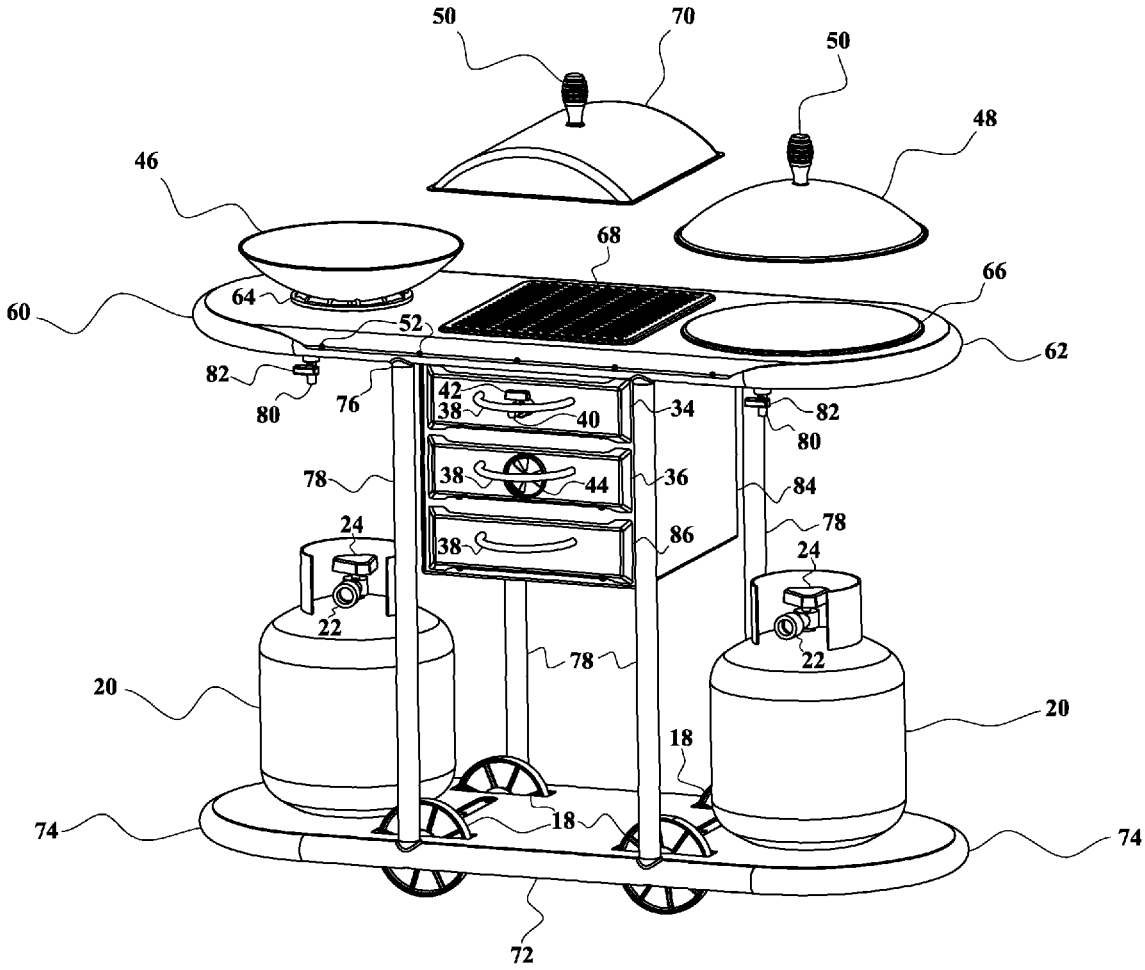
FIG. 7 is a perspective view of the second preferred embodiment of the invention.

FIG. 7 is a perspective view of the second preferred embodiment of the invention 60, including a surface plate 62 with three openings for a wok grill 64, a circular teriyaki plate 66, and a rectangular barbeque grill plate 68. In the second embodiment, all three cooking surfaces are provided at once, and they are not exchanged. A rectangular lid 70 is provided to cover the barbeque grill plate, while rounded lids 48 may cover the teriyaki plate and the wok. The bottom panel 72 has more rounded ends 74 than in the first embodiment. The frame assembly 76 includes supporting members 78 that are located closer to the center than in the first embodiment. Two gas tanks 20 rest on the bottom panel. Two gas inlets 80 extend downward from the surface plate, adjacent to the wok grill and the teriyaki plate. Each gas inlet has a control knob 82. The wok grill and the teriyaki plate are always heated by gas in the second embodiment. The barbeque grill may be heated by either gas or solid fuel. A smaller but deeper cabinet assembly 84 than in the first embodiment lies between the supporting members, with slots for three drawers. There is only one gas burning drawer 34 and one solid fuel burning drawer 36 (which are the same as in the first embodiment). There is also a storage drawer 86, which does not provide heat. The drawers may be exchanged, as in the first embodiment. The uppermost drawer provides heat to the barbeque grill.

Figure 8:
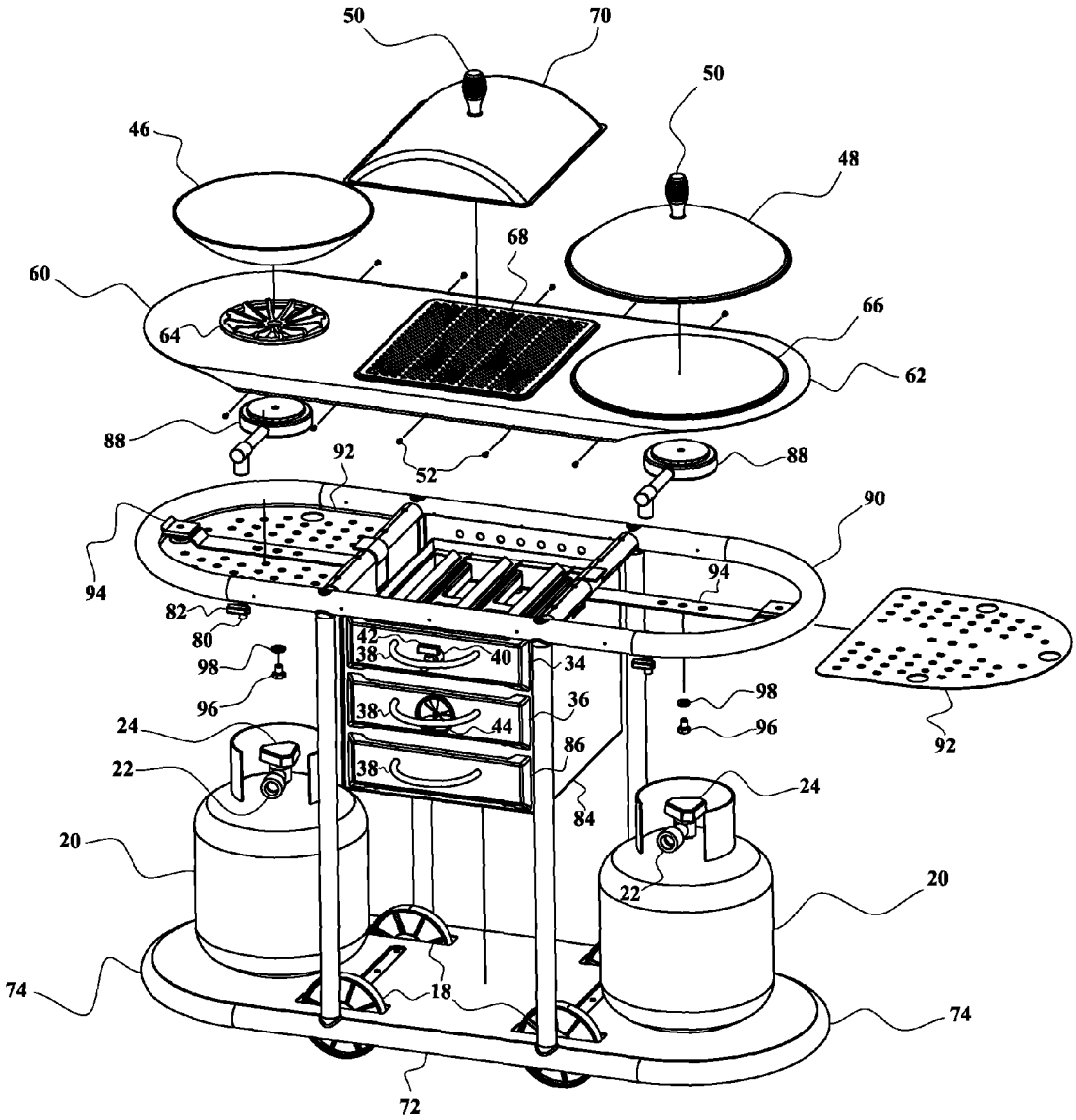
FIG. 8 is an exploded perspective view of the second preferred embodiment of the invention.

FIG. 8 is an exploded perspective view of the second preferred embodiment of the invention, showing the gas burners 88 (preferably round and made of cast iron) under the wok grill and teriyaki plate, the upper supporting frame 90 on which the surface plate is retained, guards 92 (preferably made of steel with a power coat finish) that are retained on braces 94 by screws 96 and washers 98.

Figure 9:
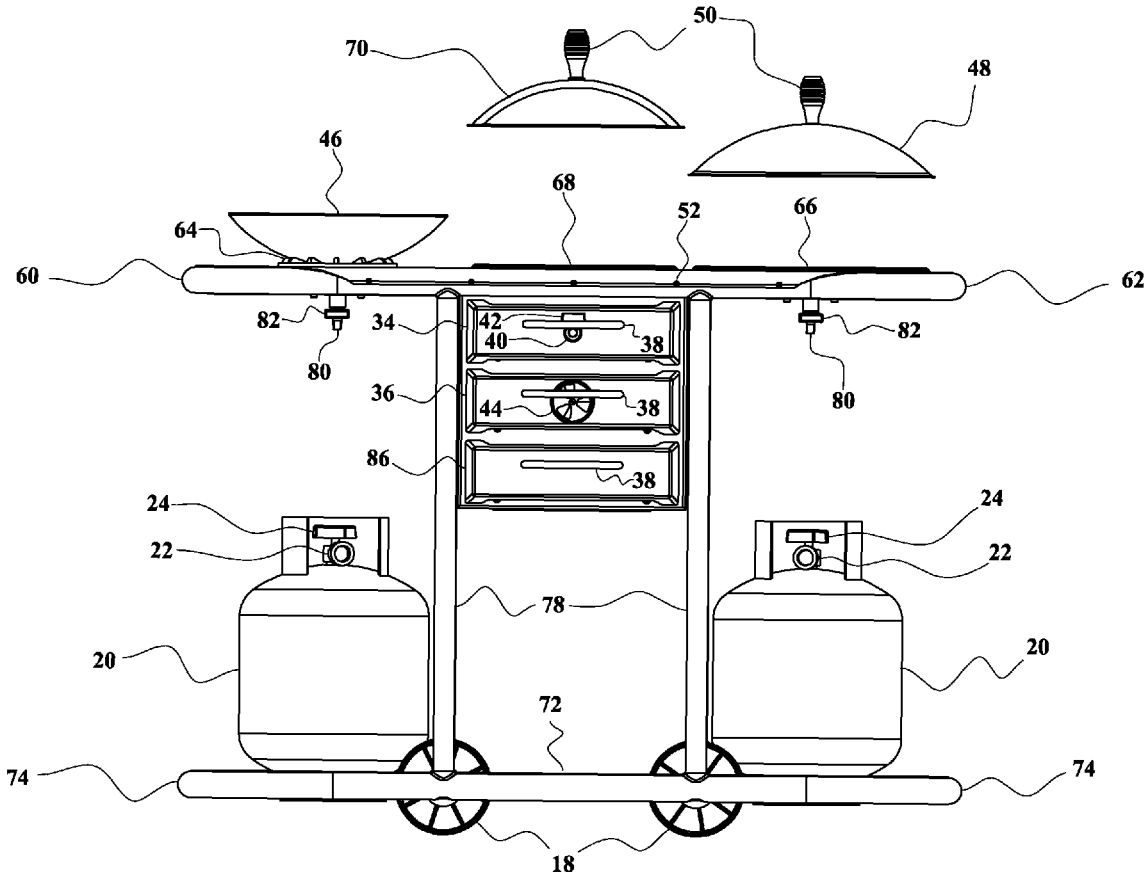
FIG. 9 is a front elevational view of the second preferred embodiment of the invention.
Figure 10:
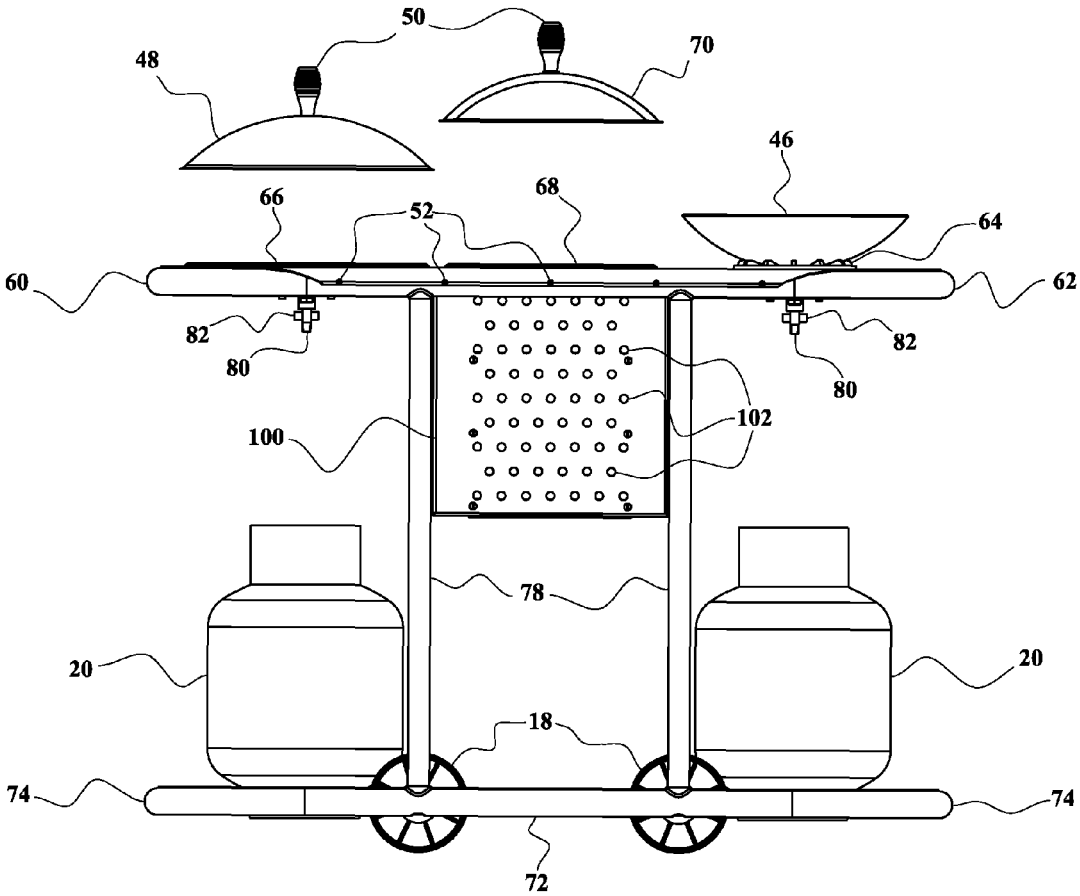
FIG. 10 is a rear elevational view of the second preferred embodiment of the invention.
Figure 11:
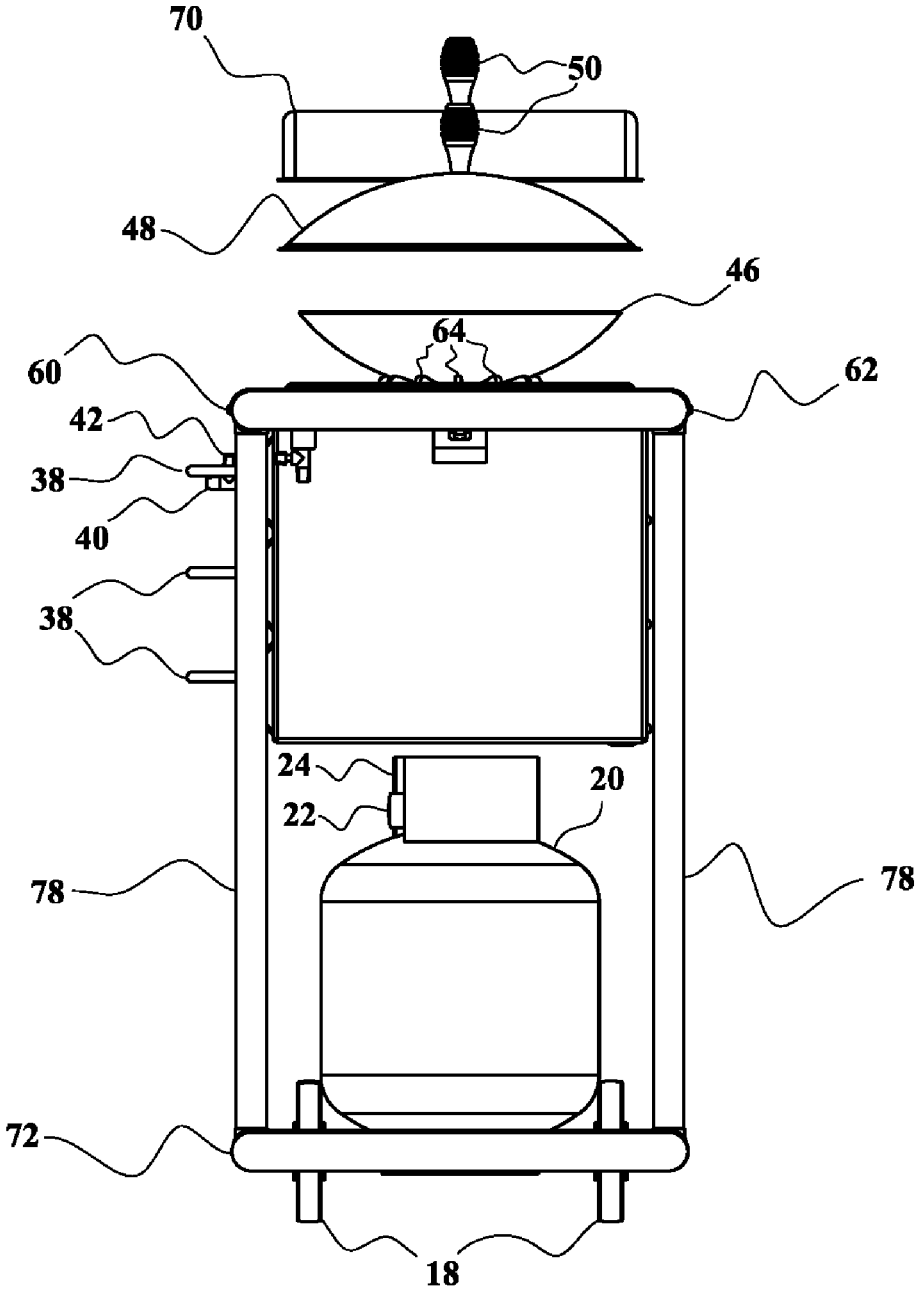
FIG. 11 is a right side elevational view of the second preferred embodiment of the invention.
Figure 12:
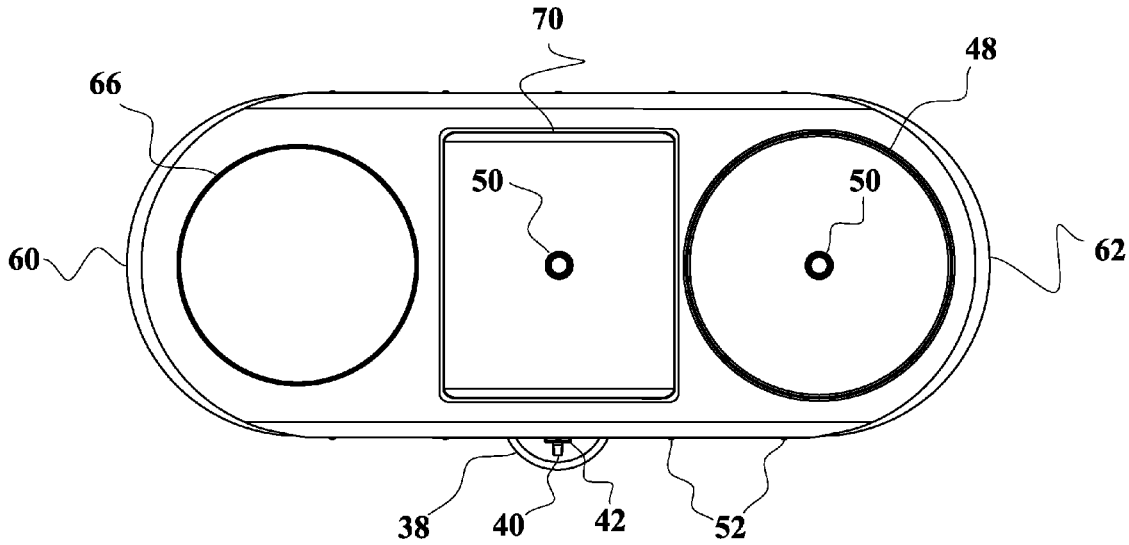
FIG. 12 is a top plan view of the second preferred embodiment of the invention.

FIG. 9 is a front elevational view of the second preferred embodiment of the invention. FIG. 10 is a rear elevational view of the second preferred embodiment of the invention, showing the rear panel 100 of the cabinet assembly, with numerous apertures 102 for air flow. FIG. 11 is a right side elevational view of the second preferred embodiment of the invention. FIG. 12 is a top plan view of the second preferred embodiment of the invention.

Figure 13:
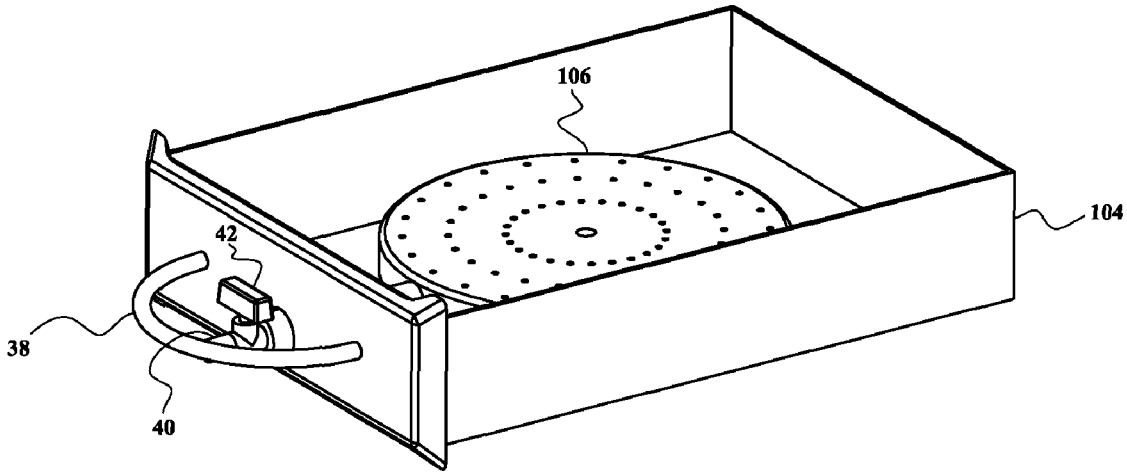
FIG. 13 is a perspective view of a first type of gas burning drawer.
Figure 14:
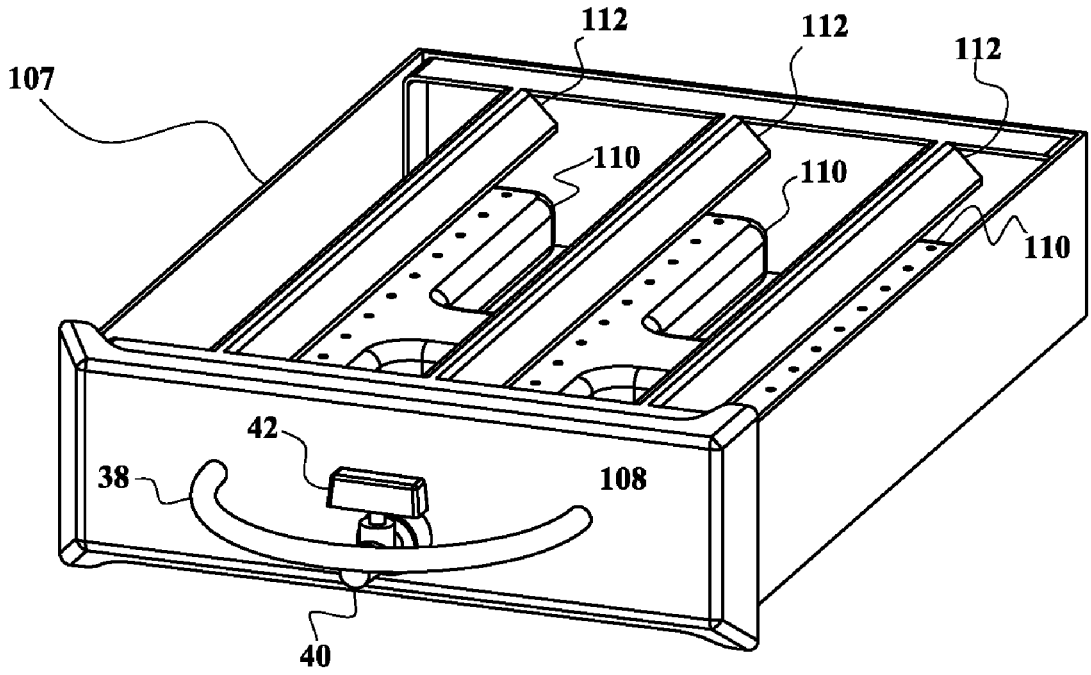
FIG. 14 is a perspective view of a second type of gas burning drawer.

FIG. 13 is a perspective view of a first type of gas burning drawer 104, that may be used with either of the preferred embodiments of the invention, having a round gas burner 106. FIG. 14 is a perspective view of a second type of gas burning drawer 107, that may also be used with either of the preferred embodiments of the invention, having a gas burner 108 with three arms 110, above which are shielding members 112.

Figure 15:
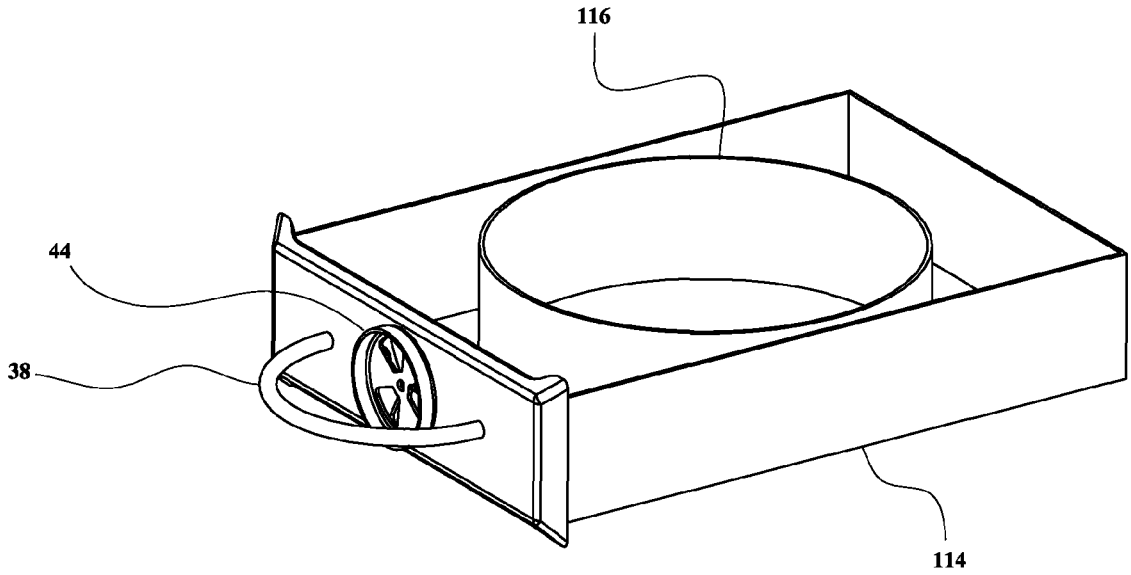
FIG. 15 is a perspective view of a first type of solid fuel burning drawer.
Figure 16:
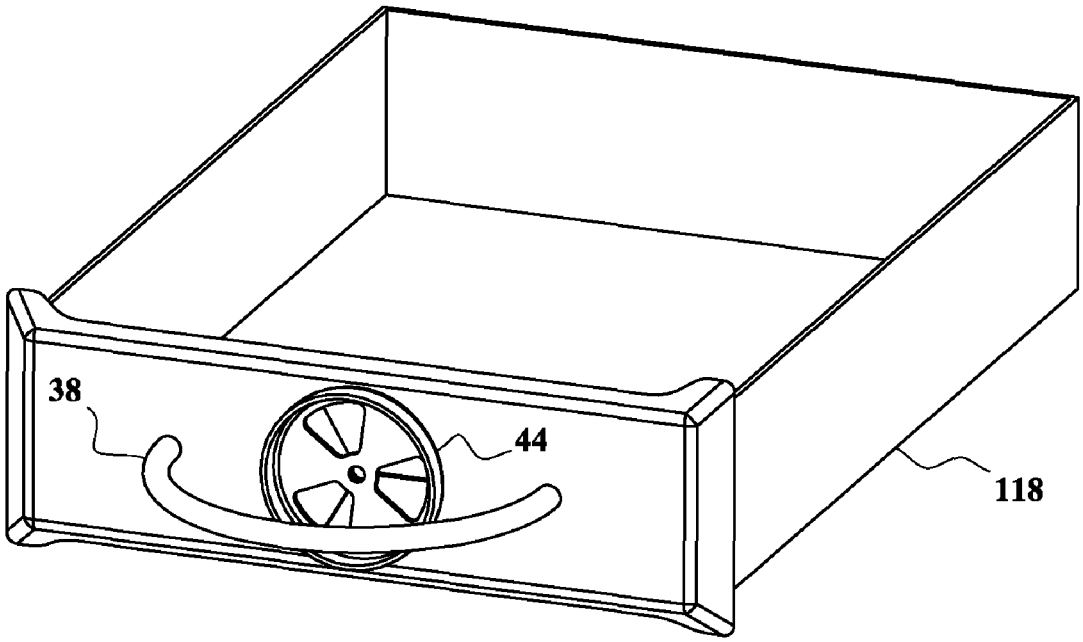
FIG. 16 is a perspective view of a second type of solid fuel burning drawer.

FIG. 15 is a perspective view of a first type of solid fuel burning drawer 114, that may be used with either of the preferred embodiments of the invention, having a retaining wall 116 for keeping the burning fuel in the center of the drawer. FIG. 16 is a perspective view of a second type of solid fuel burning drawer 118, that may also be used with either of the preferred embodiments of the invention, without the retaining wall.

Figure 17:
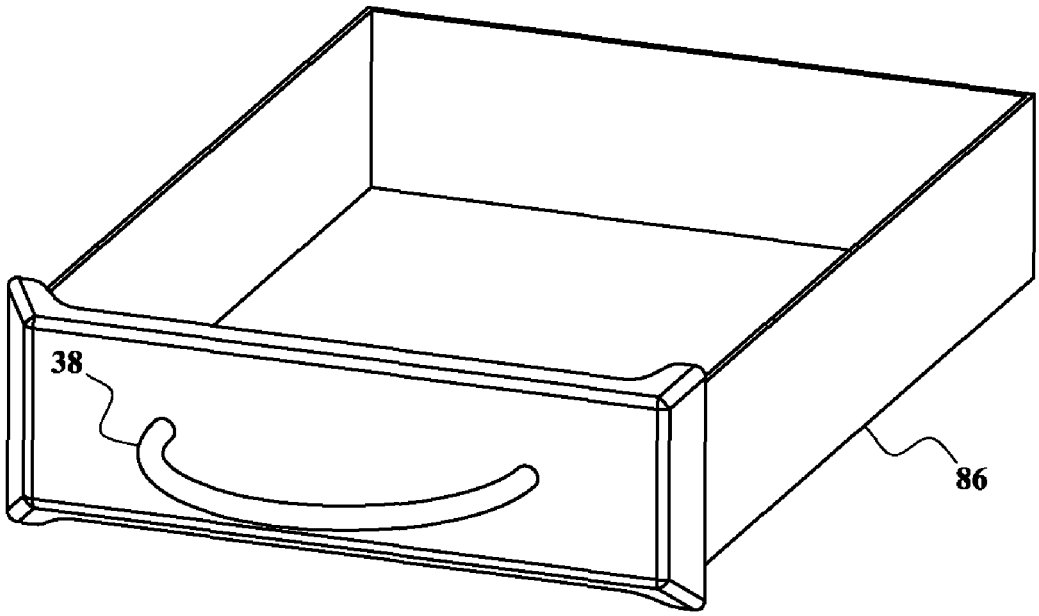
FIG. 17 is a perspective view of a storage drawer.

FIG. 17 is a perspective view of the storage drawer that is included in the second preferred embodiment of the invention. Optionally, the storage drawer may also be included in the first embodiment of the invention.

It is to be understood that the present invention is not limited to the preferred embodiments described above, but encompasses any and all embodiments within the scope of the following claims.

We claim:

1. A cooking apparatus, comprising:

a frame assembly including a surface plate with a first cooking area having a radially centered grill, a second cooking area having a flat heating surface without apertures, and a third cooking surface with a grill having numerous elongated apertures in a staggered array;

a cabinet assembly attached to the frame assembly, including vertically aligned slots for drawers below the third cooking surface;

a gas burning drawer that can be removably inserted into any of the slots; and a solid fuel burning drawer that can be removably inserted into any of the slots.

2. The cooking apparatus according to claim 1, wherein there are three slots for drawers in the cabinet assembly, and there is a storage drawer that can be removably inserted into at least one of the slots.

3. The cooking apparatus according to claim 2, wherein the drawer in the uppermost slot can supply heat to the third cooking area, unless it is the storage drawer.

4. The cooking apparatus according to claim 1, wherein there are gas burners below the first and second cooking areas.

5. The cooking apparatus according to claim 4, wherein there is a first gas inlet for the gas burner below the first cooking area, and a second gas inlet for the gas burner below the second cooking area.

6. The cooking apparatus according to claim 1, wherein the gas burning drawer has a gas burner and an inlet by which it can be connected to a gas supply.

7. The cooking apparatus according to claim 1, wherein the solid fuel burning drawer has an adjustable air vent.

8. The cooking apparatus according to claim 1, including a bottom panel with wheels, and supporting members connecting the bottom panel and the surface plate, with the cabinet assembly being between the supporting members, and with apertures in a rear panel of the cabinet assembly.

9. The cooking apparatus according to claim 1, including two gas tanks for supplying fuel to gas burners below the first and second cooking areas and the gas burning drawer.

10. The cooking apparatus according to claim 1, including a wok, at least one rounded lid for covering the wok and the first and second cooking areas, and a rectangular lid for covering the third cooking area.

11. The cooking apparatus according to claim 1, wherein the gas burning drawer has a gas burner with arms, and a shielding member above each arm.

12. The cooking apparatus according to claim 1, wherein the solid fuel burning drawing has a circular retaining wall around a center portion of the drawer, that can retain the solid fuel in the center portion.

13. The cooking apparatus according to claim 1, wherein the third cooking surface is in the center, with the first and second cooking surfaces on opposites sides of it.

14. The cooking apparatus according to claim 1, wherein all the cooking surfaces are at the same level.

* * * * *